US006719544B2

(12) United States Patent
Genevois

(10) Patent No.: US 6,719,544 B2
(45) Date of Patent: Apr. 13, 2004

(54) VALVE FOR SCROLL COMPRESSOR

(75) Inventor: David Genevois, Cailloux-sur-Fontaine (FR)

(73) Assignee: Danfoss Maneurop S.A., Trevoux (FR)

( * ) Notice: Subject to any disclaimer, the term of this patent is extended or adjusted under 35 U.S.C. 154(b) by 0 days.

(21) Appl. No.: 10/317,345

(22) Filed: Dec. 12, 2002

(65) Prior Publication Data

US 2003/0118464 A1 Jun. 26, 2003

(30) Foreign Application Priority Data

Dec. 20, 2001 (FR) ..... 01 16608

(51) Int. Cl.[7] ..... F04C 18/04; F04C 29/00; F16K 15/00; F16K 15/06

(52) U.S. Cl. ..... 418/55.1; 418/270; 137/542; 137/543.15

(58) Field of Search ..... 418/55.1, 270; 137/516.15, 516.17, 540, 542, 543, 543.13, 543.15

(56) References Cited

U.S. PATENT DOCUMENTS 4,548,234 A 10/1985 Prenger
5,469,884 A * 11/1995 Madrid ..... 137/540
6,132,191 A 10/2000 Hugenroth et al.
6,179,589 B1 1/2001 Bass et al.

FOREIGN PATENT DOCUMENTS

| | | |
|---|---|---|
| DE | 326599 | 5/1918 |
| JP | 57153988 | 9/1982 |
| JP | 8319973 | 12/1996 |

* cited by examiner

*Primary Examiner*—John J. Vrablik
(74) *Attorney, Agent, or Firm*—McCormick, Paulding & Huber LLP

(57) ABSTRACT

In a valve used in connection with a scroll compressor, a central profiled body is designed to protrude in an opening for outlet of gas from a compression stage, a outer axisymmetric surface of which is concave, of generally toroidal shape, and is terminated by a tip, the outlet opening of the compression stage being delimited by a curved surface forming, in the downstream direction, a widening providing, with the central profiled body, a cross section for the passage of the gas which is substantially constant, closing means being provided in order to seal this passage in the closed position of the valve.

7 Claims, 6 Drawing Sheets

VALVE FOR SCROLL COMPRESSOR

CROSS-REFERENCE TO RELATED APPLICATIONS

This application is entitled to the benefit of and incorporates by reference essential subject matter disclosed in French Patent Application No. 01.16608 filed on Dec. 20, 2001 in the name of Danfoss Manuerop S. A.

FIELD OF THE INVENTION

The subject of the present invention is a valve for a scroll compressor, and more particularly a valve placed between the compression stage of the compressor and the high-pressure compartment thereof.

BACKGROUND OF THE INVENTION

The valve according to the invention is equally applicable to scroll compressors comprising a fixed spiral element and a movable spiral element as to compressors in which both spiral elements can be moved.

FIG. 1 of the appended schematic drawing shows a scroll compressor in which one of the spiral elements is fixed and the other can be moved.

Such a scroll compressor comprises an enclosure 2, the upper part of which is formed by a cap 3. This enclosure 2 is separated into two compartments, a low-pressure gas-inlet compartment 4, and a high-pressure compartment 5 for outlet of the compressed gas. Theses two compartments are separated by a gas compression stage 6. The gas is admitted into the low-pressure compartment via an inlet orifice 7 and the compressed gas is discharged from the high-pressure compartment 5 via an orifice 8.

The compression stage 6 consists of a fixed spiral element 9 and a movable spiral element 10, these two elements comprising interpenetrating parts and together defining compression pockets 12. The movable spiral element 10 is driven by a shaft 13, in an orbital movement, the movement of the shaft 13 being provided by a motor 14. During the orbital movement of the element 10, the compression pockets 12 have a volume which gradually decreases from the outside, where the gas is admitted into the low-pressure compartment, towards the inside, the compressed gas leaving at the centre of the compression stage 6 to the high-pressure compartment 5 through a valve denoted by the general reference 15 in FIG. 1.

This valve is a delivery valve which prevents the return flow of fluid from the high-pressure chamber 5 to the compression pockets 12. This valve plays a role, not only in shut-down of the compressor, but also in operation, in so far as when the compression stage has a fixed compression rate and when the last compression pocket is in communication with the outlet orifice of the gas, the pressure may be less than the pressure in the high-pressure chamber 5. The valve therefore isolates the chamber 5 from the compression pockets while the pressure upstream of the valve is less than the pressure in the high-pressure chamber.

There are various solutions for producing delivery valves. Some valves consist of one or more lamella plates which are free or combined with springs.

Other valves, such as those described in document U.S. Pat. No. 6 179 589, or in document JP 07 127 745 comprise a convex shape, having an active surface which is rounded or of frustoconical shape.

The various valves known on the market have a number of drawbacks and especially produce a considerable dead volume upstream of the valve, allowing the gas to expand in the following pocket, giving high pressure drops, causing turbulent flow resulting in a high acoustic level of operation, some of them being of large mass resulting in a long response time and providing a path for the gas which has edges, which disturbs the fluid flow.

The aim of the invention is to provide a valve for a scroll compressor, reducing the pressure drops and the turbulence on passage of the gas, and delimiting, upstream of the valve, as small a dead volume as possible.

SUMMARY OF THE INVENTION

To this end, the valve to which it relates, designed to be fastened to the element of the compression stage located on the same side as the high-pressure compartment, comprises a central profiled body designed to protrude in an opening for outlet of the gas from the compression stage, the outer axisymmetric surface of which is concave, of generally toroidal shape, and is terminated by a tip, the outlet opening of the compression stage being delimited by a curved surface forming, in the downstream direction, a widening providing, with the central profiled body, a cross section for the passage of the gas which is substantially constant, closing means being provided in order to seal this passage in the closed position of the valve.

Given the shape of the central part of the valve, and especially of the pointed end thereof, there is no blocking of the gas at this end. Furthermore, the toroidal shape of the outer surface of the valve provides a gradual change of direction, without any discontinuity, since there are no edges, and the cross section and the gas speed are kept substantially constant. The valve therefore has very quiet operation, and the pressure drops are small. Furthermore, the protrusion of the central profiled body into the opening for outlet of gas from the compression stage limits the dead volume.

According to a first embodiment of this valve, at least part of the central profiled body can be moved axially, forming a closing element.

According to one possibility in this event, the entire central body is mounted so that it can slide on a fixed central support and is subjected to the action of a spring placed between the support and the body promoting the actuation of the body to pass to its closed position, when the pressure in the high-pressure compartment is greater than the pressure of the gas at the outlet of the compression stage.

According to another possibility in this event, the central profiled body is made in two concentric parts: a central part belonging to a fixed support and comprising the tip, and a peripheral part mounted so that it can slide on the central fixed part, this second part forming the closing element and closing the valve under the action of a spring by pressing on the curved surface delimiting the outlet opening of the compression stage, when the pressure in the high-pressure compartment is greater than the pressure at the outlet of the compression stage, the outer surfaces respectively of the central part and of the peripheral part being in alignment with each other and delimiting the toroidal surface, in the open position of the valve.

It should be noted that, given the shapes of the outer surface of the central body and of the curved surface which delimits the opening for outlet of the gas, respectively, contact of the central body on the curved surface which forms a seat is made along an edge, so that there is no risk of the valve sticking on its seat in the closed position, when the gas is charged with oil.

According to another embodiment of this valve, the central profiled body is fixed and a specific valve element is designed for closing the valve.

According to one possibility in this second case, the outlet opening of the compression stage ends in the bottom of a recess of generally cylindrical shape, the central profiled body being fastened to a support body held at some distance from the bottom of the recess, this support body being equipped with a closing plate subjected to the action of a spring, for facilitating the closure action, and designed, in the closed position of the valve, to bear against the bottom of the cylindrical recess, in order to seal the annular space between the central profiled body and the surface delimiting the outlet opening of the compression stage.

Advantageously, the support body comprises axial holes ending on the same side as the high-pressure compartment in order to subject the surface of the closing plate and/or of the spring acting on this plate to the pressure of the high-pressure compartment.

In any event, the invention will be clearly understood by means of the following description, with reference to the appended schematic drawing, presenting several embodiments of this delivery valve by way of non-limiting examples.

DETAILED DESCRIPTION OF THE PREFERRED EMBODIMENT

Figure 1:
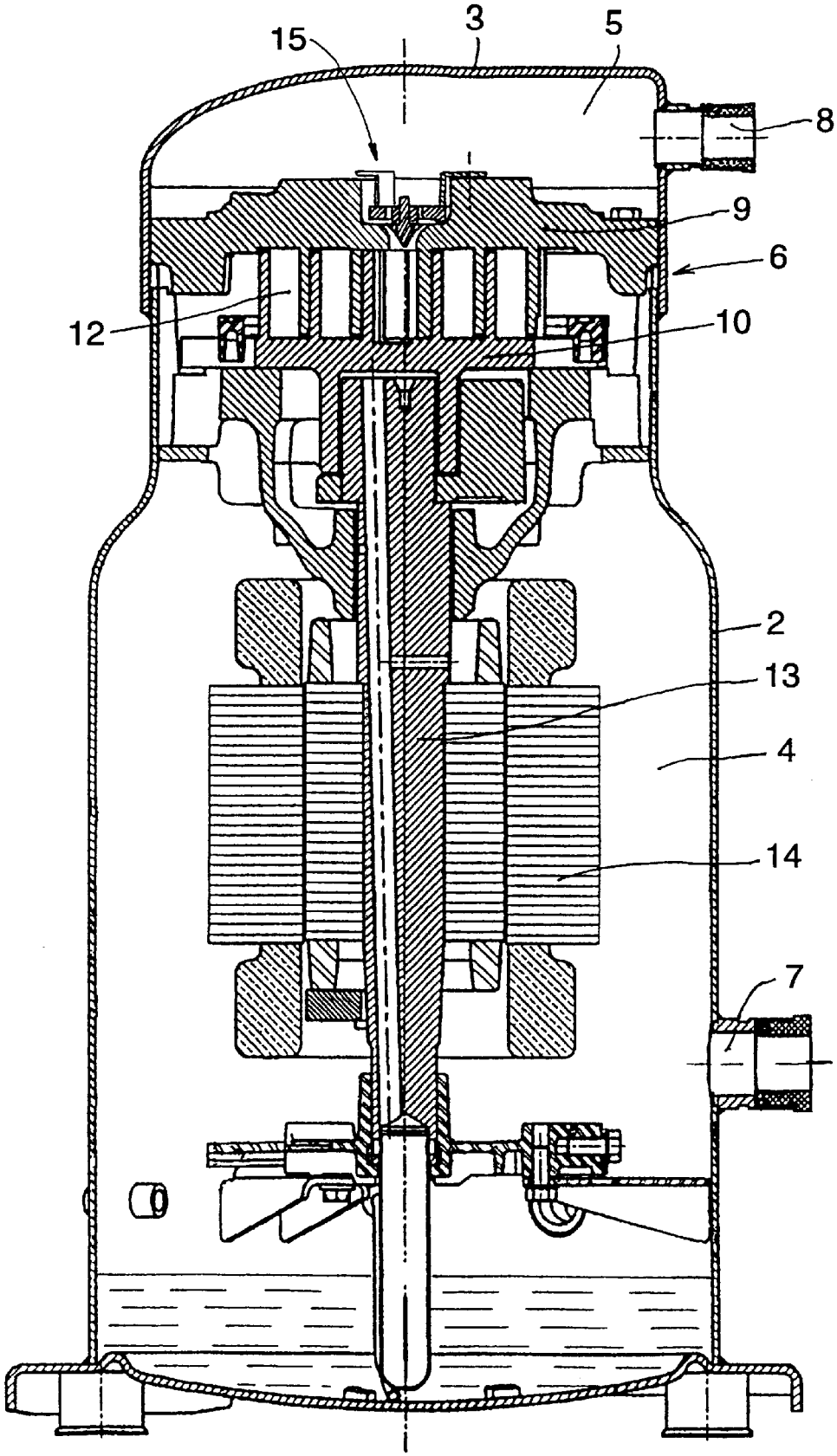
FIG. 1 is a view in longitudinal section of a scroll compressor, as described above.
Figure 2:
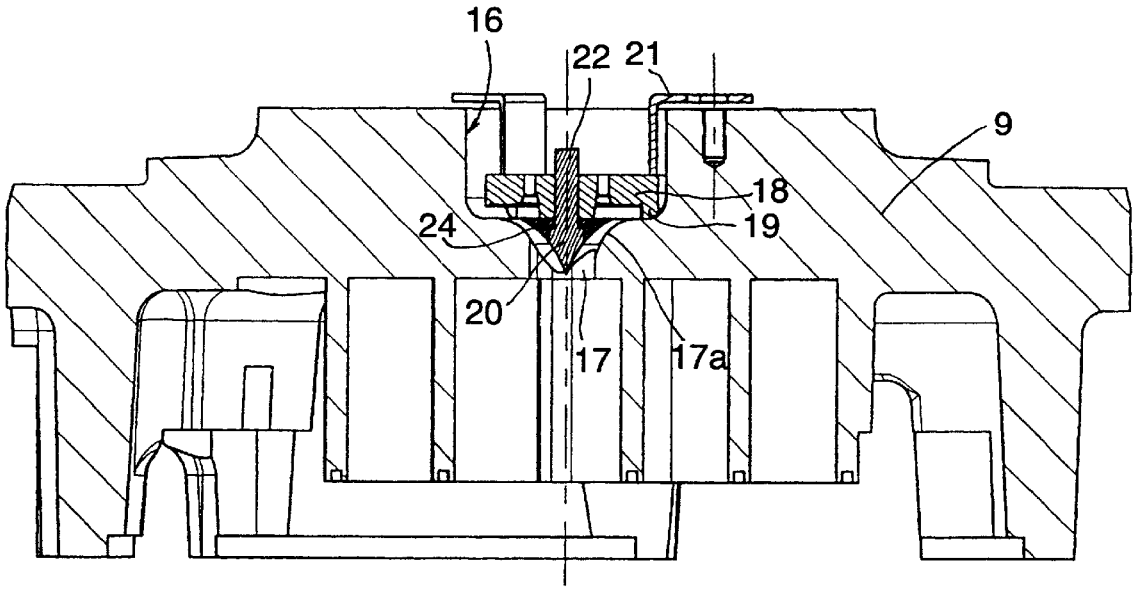
FIG. 2 is a view in longitudinal section and on an enlarged scale of the fixed spiral element and of a first valve.
Figure 3:
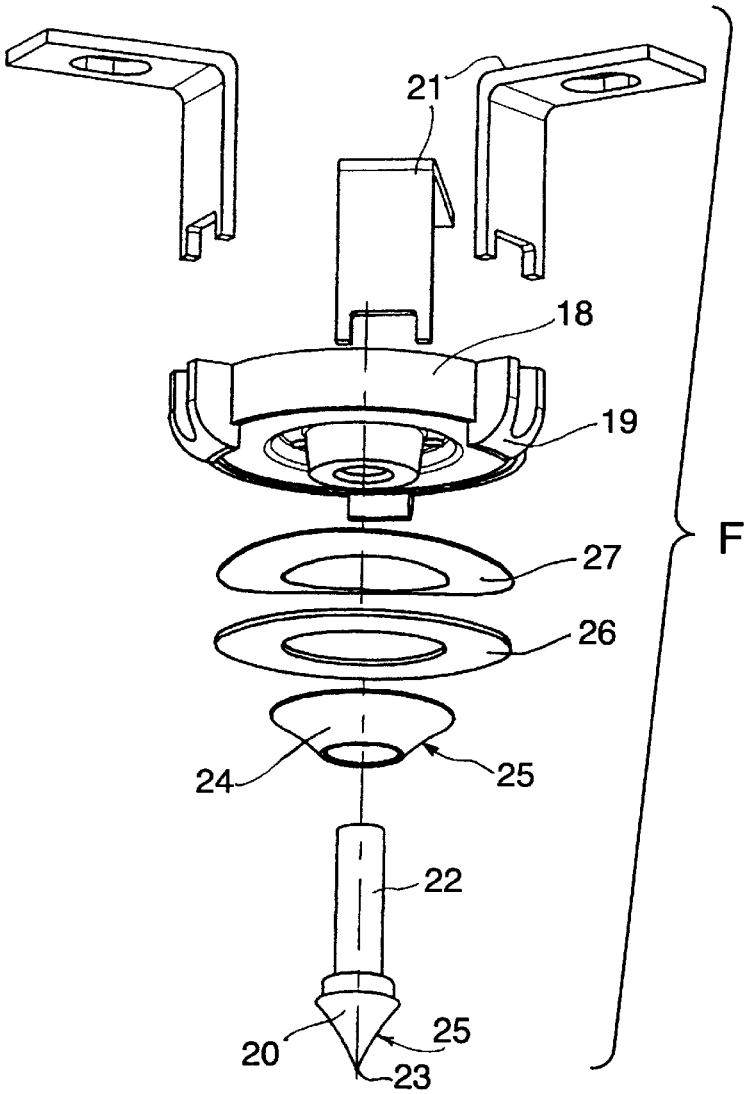
FIG. 3 is an exploded perspective view on an enlarged scale of the valve of FIG. 2.

The valve shown in FIGS. 2 to 5 is designed to be housed in a recess 16 of generally cylindrical shape made in the wall of the fixed spiral element 9 located on the same side as the high-pressure compartment 5 of the compressor.

The opening 17 for outlet of the compressed gas from the compression stage is delimited by a curved surface 17*a*, widening in a downstream direction.

A support body 18, held by three tabs 21 fastened to the wall plate of the fixed element 9, for example by screws, and bearing against the bottom of the recess 16 via three protrusions 19, is mounted in the recess 16. A central body 20 of the valve, comprising a cylindrical rod 22 fastened in the body 18, for example by screwing, by a bolt or riveted, and which is extended by an outer part terminating in a tip 23, is mounted in the support body 18. The outer part of the central body 20 is extended in the downstream direction by a collar 24. The body 20 and the collar 24, which are securely fastened, form, starting from the tip 23, a concave surface 25 of toroidal shape. This surface 25 delimits, with the curved surface 17*a*, a passage for the gas leaving the compression stage forming, in the downstream direction, a widening providing a cross section for the passage of gas which is substantially constant. The collar 24 extends to the plane of the bottom of the recess 16. A lamella plate 26, forming the closing element and intended to seal the passage of gas delimited by the surfaces 17*a* and 25, is mounted in the body 18. This plate is housed, along with a leaf spring 27, in a recess of the support body 18. The support body 18 has holes 18*a* communicating with the high-pressure compartment so that the surface of the spring 27, turned towards this compartment, is subjected to the pressure of the compartment.

Figure 5:
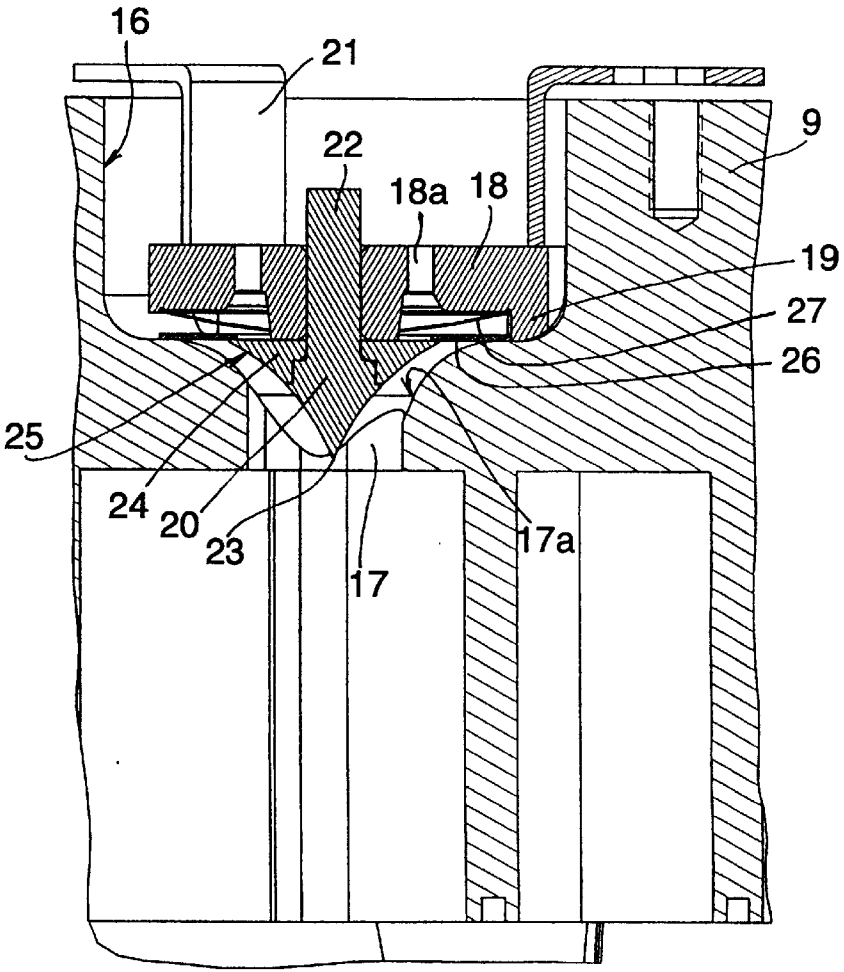
FIGS. 4 and 5 are two views in partial longitudinal section of the mounted valve of FIGS. 2 and 3, in the open position and in the closed position, respectively.
Figure 4:
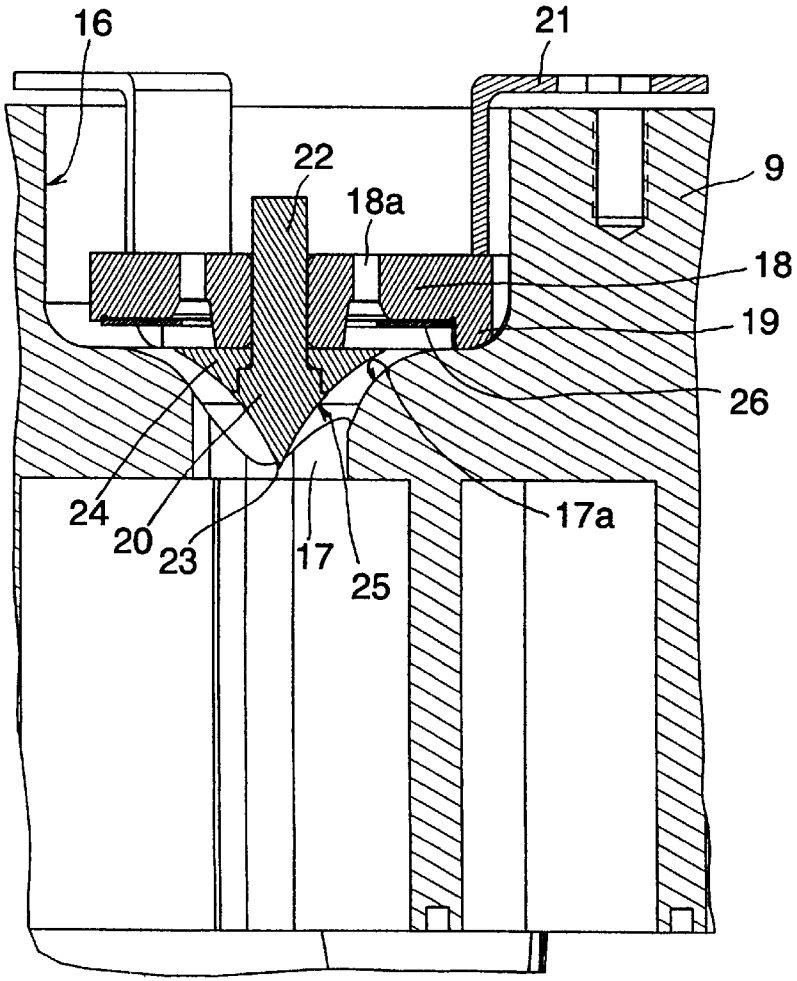

In practice, when the pressure of the compression stage is greater than the pressure inside the high-pressure compartment 5, the closing element 26 is pressed in the upper position, as shown in FIG. 4, opposing the action of the spring 27. When the pressure in the high-pressure compartment 5 becomes greater than the outlet pressure of the compression stage, the closing element 26 moves downwards under the action of the spring 27 towards its closed position, as shown in FIG. 5.

Figure 7:
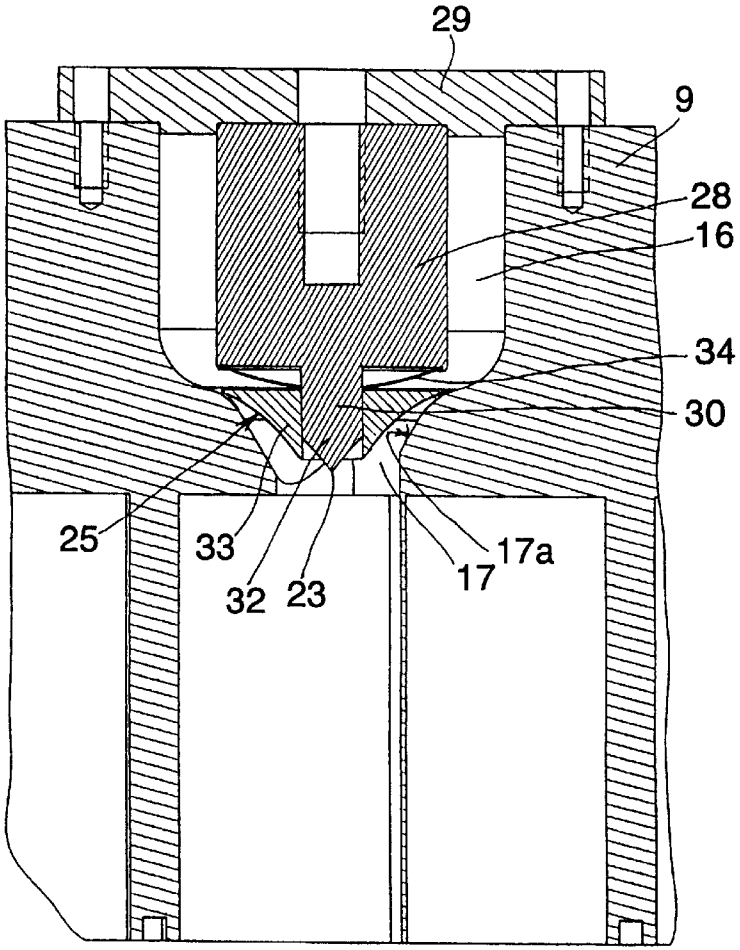
FIGS. 6 and 7 are two views in longitudinal section of a second valve in the open position and in the closed position, respectively.
Figure 6:
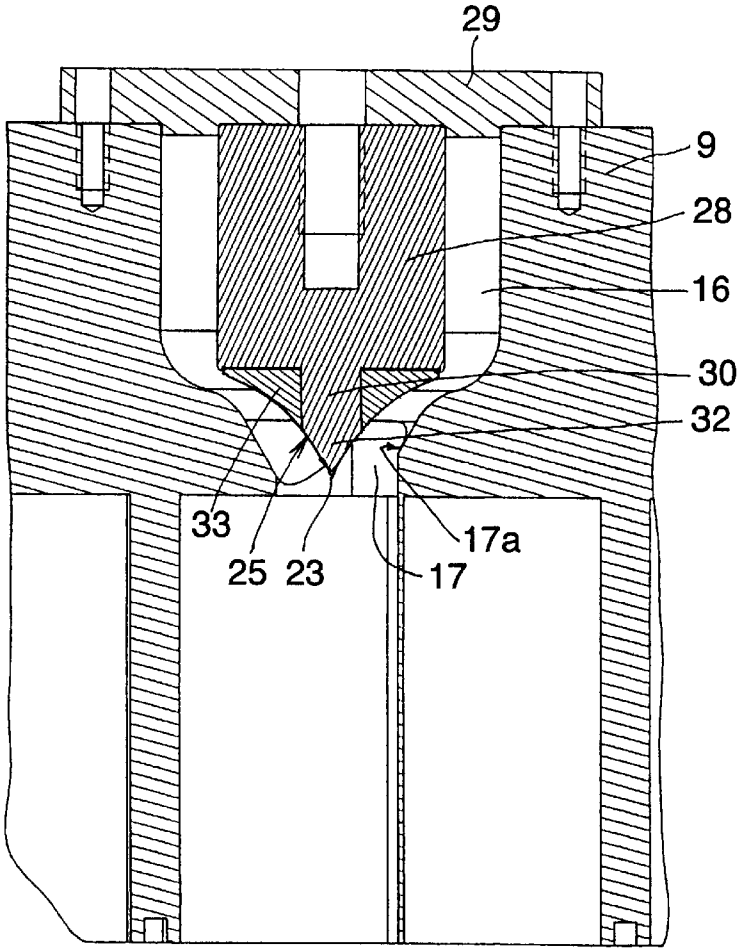

FIGS. 6 and 7 show another embodiment of this valve in which the same elements are denoted by the same references as above. This valve comprises a central support body 28 fastened on the spiral element 9 by a transverse tab 29, for example by screwing. The end of this body 28 located on the same side as the opening 17 has a smaller cross section, comprising a central cylindrical part 30 extended by a central profiled part 32 ending in a tip 23. An outer annular part 33, which can be released under the action of a spring 34, is mounted so that it can slide on the central cylindrical part 30, as shown in FIG. 7.

As is apparent, especially from FIG. 6, the central part 32 and the outer part 33 delimit a toroidal surface 25, located facing the curved surface 17*a* delimiting the opening 17.

In the open position shown in FIG. 6, this surface 25 is continuous. When the pressure, in the high-pressure compartment 5, becomes greater than the outlet pressure of the compression stage, the annular part 33 slides along the central part 30, closing, as shown in FIG. 7, the gas passage made between the surface 17*a* and the surface 25.

Figure 9:
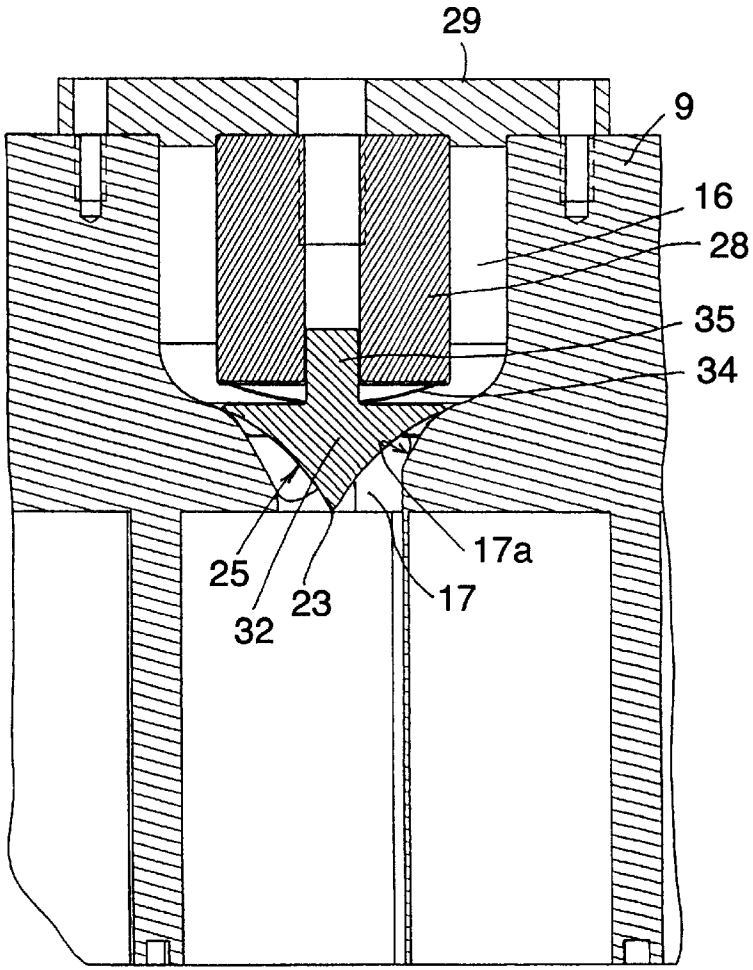
FIGS. 8 and 9 are two views in longitudinal section of another valve in the open position and in the closed position, respectively.
Figure 8:
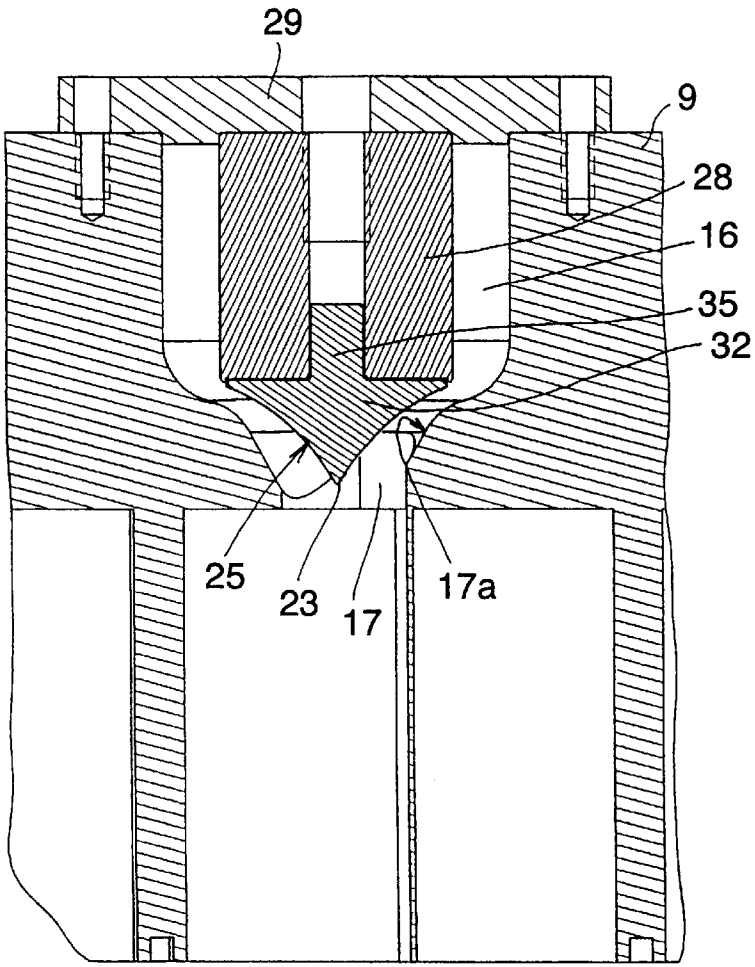

FIGS. 8 and 9 show another embodiment in which the same elements are denoted by the same references as above. In this case, the central profiled body 32 is mounted so that it can slide via a rod-shaped posterior part 35 inside the support body 28. The entire toroidal surface 25 is then delimited by the central body 32. This valve is shown in the open position and in the closed position, respectively, in FIGS. 8 and 9.

Figure 10:
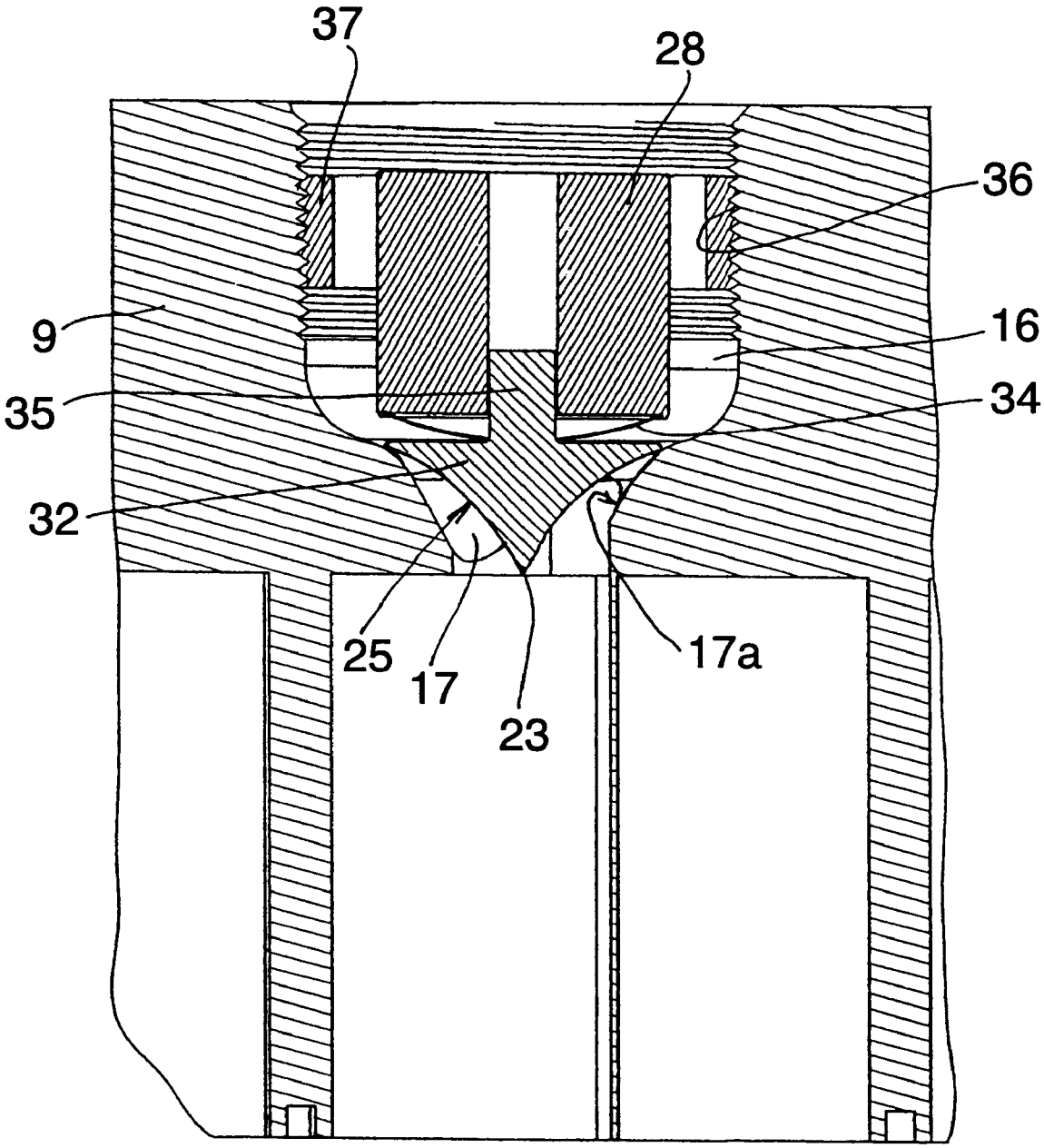
FIG. 10 is a view in longitudinal section and in the closed position of a variant of the valve of FIGS. 8 and 9.

FIG. 10 is a variant of the valve of FIGS. 8 and 9 in which the recess 16 comprises a thread 36 allowing the support element 28 of the central body to be fastened via a threaded ring 37.

As is apparent from the above, the invention brings a considerable improvement to the existing art by providing a valve having a simple structure, made with a limited number of parts, and limiting the pressure drops, the operational noise and the dead volume located upstream of the valve.

As goes without saying, the invention is not limited just to the embodiments of this valve described above by way of example, but on the contrary it encompasses all variants thereof.

What is claimed is:

1. A valve for a scroll compressor comprising:

a low pressure compartment;

a high pressure compartment;

a compression stage having an outlet, said low and high pressure compartments being separated by said compression stage;

a delivery valve coupled to said outlet and movable between an open position, and a closed position wherein gas is prevented from passing from the high pressure compartment to the compression stage;

a central profiled body extending into an opening in the compression stage for allowing gas to escape therefrom, the central profiled body comprising an outer, concave, axisymmetric surface, the axisymmetric surface being generally toroidal and terminating in a tip;

the outlet of the compression stage being delimited by a curved surface forming a widened portion in a downstream direction;

the widened portion and the central profiled body cooperating to define a substantially constant cross-sectional area for the passage of gas; and closing means for sealing the cross-sectional area when the valve is in the closed position.

2. A valve according to claim 1, wherein at least part of the central profiled body can be moved axially, thereby forming a closing element.

3. A valve according to claim 2, wherein a central profiled body is slidably mounted on a fixed central support, biasing means placed between the support and the central profiled body urge the central profiled body toward a closed position when the pressure in the high-pressure compartment is greater than the pressure of the gas at the outlet of the compression stage.

4. A valve according to claim 2, wherein the central profiled body is made of two substantially concentric parts: a central part belonging to a fixed central support, said central part comprising the tip, and a peripheral part slidably mounted on the central fixed part, this peripheral part forming the closing element and closing the valve under the action of a spring by pressing on the curved surface delimiting the outlet opening of the compression stage, when the pressure in the high-pressure compartment is greater than the pressure at the outlet of the compression stage, the outer surfaces respectively of the central part and of the peripheral part being in substantial alignment with each other and delimiting the toroidal surface, when the valve is in an open position.

5. A valve for a scroll compressor comprising:

a low pressure compartment;

a high pressure compartment;

a compression stage having an outlet, said low and high pressure compartments being separated by said compression stage;

a delivery valve coupled to said outlet and movable between an open position, and a closed position wherein gas is prevented from passing from the high pressure compartment to the compression stage;

a central profiled body extending into an opening in the compression stage for allowing gas to escape therefrom, the central profiled body comprising an outer, concave, axisymmetric surface, the axisymmetric surface being generally toroidal and terminating in a tip;

the outlet of the compression stage being delimited by a curved surface forming a widened portion in a downstream direction;

the widened portion and the central profiled body cooperating to define a substantially constant cross-sectional area for the passage of gas; and closing means for sealing the cross-sectional area when the valve is in the closed position, wherein the central profiled body is fixed and a specific valve element is provided for closing the valve.

6. A valve according to claim 5, wherein the outlet opening of the compression stage ends in a bottom of a recess of generally cylindrical shape, the central profiled body being fastened to a support body held at some distance from the bottom of the recess, the support body being equipped with a sealing plate subjected to the action of a spring, for facilitating the closing action, and designed, in the closed position of the valve, to bear against the bottom of the cylindrical recess, in order to seal the annular space between the central profiled body and the surface delimiting the outlet opening of the compression stage.

7. A valve according to claim 1, wherein the support body comprises axial holes ending on the same side as the high-pressure compartment in order to subject at least one surface of the sealing plate and the spring acting on the sealing plate to the pressure of the high-pressure compartment.

* * * * *

UNITED STATES PATENT AND TRADEMARK OFFICE

CERTIFICATE OF CORRECTION

PATENT NO. : 6,719,544 B2
DATED : April 13, 2004
INVENTOR(S) : David Genevois

It is certified that error appears in the above-identified patent and that said Letters Patent is hereby corrected as shown below:

Column 6,
Line 41, the number "1" should be replaced with the number -- 6 --.

Signed and Sealed this

Seventeenth Day of August, 2004

JON W. DUDAS
*Acting Director of the United States Patent and Trademark Office*